US009132312B2

(12) United States Patent
Henley

(10) Patent No.: US 9,132,312 B2
(45) Date of Patent: Sep. 15, 2015

(54) HANDLE ADAPTOR FOR WEIGHT TRAINING DEVICE

(71) Applicant: Jeremy Daniel Henley, North York (CA)

(72) Inventor: Jeremy Daniel Henley, North York (CA)

( * ) Notice: Subject to any disclaimer, the term of this patent is extended or adjusted under 35 U.S.C. 154(b) by 110 days.

(21) Appl. No.: 13/778,963

(22) Filed: Feb. 27, 2013

(65) Prior Publication Data

US 2013/0244842 A1 Sep. 19, 2013

Related U.S. Application Data

(60) Provisional application No. 61/603,511, filed on Feb. 27, 2012.

(51) Int. Cl.

| | |
|---|---|
| ***A63B 21/072*** | (2006.01) |
| ***A63B 21/075*** | (2006.01) |
| ***A63B 21/00*** | (2006.01) |

(52) U.S. Cl.

CPC ..... *A63B 21/0726* (2013.01); *A63B 21/072* (2013.01); *A63B 21/1469* (2013.01); *A63B 21/0724* (2013.01); *A63B 2021/0722* (2013.01)

(58) Field of Classification Search

CPC .... A63B 21/06; A63B 21/072; A63B 21/075; A63B 1/0608; A63B 1/0724; A63B 1/0726; A63B 21/0728; A63B 2021/06; A63B 2021/072; A63B 2021/0722; A63B 2244/09

USPC ..... 482/106–108, 44, 49–50, 92–94, 98, 482/104, 133, 135–139

See application file for complete search history.

(56) References Cited

U.S. PATENT DOCUMENTS

| | | | | |
|---|---|---|---|---|
| 734,062 | A * | 7/1903 | Harris | 482/108 |
| 2,476,734 | A * | 7/1949 | Jellison | 294/82.32 |
| 2,655,300 | A * | 10/1953 | Willms | 294/165 |
| 3,164,406 | A * | 1/1965 | Barry | 294/199 |
| 4,743,017 | A * | 5/1988 | Jaeger | 482/108 |
| 5,163,887 | A | 11/1992 | Hatch | |
| 5,344,375 | A * | 9/1994 | Cooper | 482/106 |
| 5,496,243 | A * | 3/1996 | Allen | 482/106 |
| 5,573,484 | A * | 11/1996 | Carpenter | 482/108 |
| 5,630,776 | A * | 5/1997 | Yang | 482/104 |
| 5,651,758 | A * | 7/1997 | Cervantes | 482/93 |
| 6,338,702 | B1 * | 1/2002 | Jordan | 482/108 |
| 7,052,445 | B2 | 5/2006 | Ekhuas | |
| 7,566,292 | B1 | 7/2009 | Hauser et al. | |
| 7,674,214 | B2 | 3/2010 | Marethouse et al. | |
| 8,267,841 | B1 * | 9/2012 | Allison et al. | 482/108 |
| 8,684,889 | B1 * | 4/2014 | Berrisford | 482/49 |
| 2011/0111929 | A1 | 5/2011 | Allison et al. | |
| 2011/0177922 | A1 * | 7/2011 | Selinger | 482/107 |
| 2012/0252641 | A1 * | 10/2012 | Odneal et al. | 482/108 |
| 2013/0210589 | A1 * | 8/2013 | Thompson et al. | 482/108 |

OTHER PUBLICATIONS

Modify the Tool, Not the Form, http://www.thekettleclamp.com, accessed on Nov. 14, 2014.

* cited by examiner

*Primary Examiner* — Oren Ginsberg
*Assistant Examiner* — Gary D Urbiel Goldner
(74) *Attorney, Agent, or Firm* — Manelli Selter PLLC; Edward J. Stemberger

(57) ABSTRACT

A handle adaptor is provided for a weight training device. The handle adaptor includes a handle extending from a neck having a first end and a second end. A slot is defined in the neck. The slot has an opening adapted to receive a bar of the weight training device. The slot further includes a seat for supporting the bar of the weight training device. A biasing member may also be provided to bias the bar against the seat of the slot.

20 Claims, 9 Drawing Sheets

HANDLE ADAPTOR FOR WEIGHT TRAINING DEVICE

FIELD

This specification relates to weight training devices and in particular to a handle adaptor adapted to be secured to the bar of a weight training device.

BACKGROUND

The following background discussion is not an admission that anything discussed below is citable as prior art or common general knowledge. The documents listed below are incorporated herein in their entirety by this reference to them.

A kettlebell is a form of weight training device that resembles a cannonball with a large curved handle. Kettlebells are growing in popularity as a training tool for fitness, weight loss, and athletic enhancement. They offer advantages over other weight training devices such as dumbbells.

One advantage of kettlebells is that the large curved handle allows the device to be gripped comfortably with one or two hands, in a variety of positions. This enables the performance of swinging and momentum-related exercises that are awkward or impractical with other types of weight training devices.

Another advantage of kettlebells is that the center of mass is offset from the handle. This creates non-uniform weight patterns through the various exercises, requiring recruitment of a wider range of stabilizing muscles to balance and control the device.

Another advantage of kettlebells is that kettlebell exercises provide both strength training and cardiovascular conditioning. Creating and controlling the momentum of the device develops strength, while the continual motion forces the cardiovascular system to work harder, as compared to more static traditional exercises.

However, kettlebells also have number of disadvantages over other weight training devices such as dumbbells:

One disadvantage is that they tend to be significantly more expensive than dumbbells or weight plates of equivalent weight.

Another disadvantage is that they are not as readily available as dumbbells, either at commercial gyms, hotel and condominium gyms, or home gyms.

Another disadvantage is that they most commonly are provided as a fixed single weight. Users wanting to use different weights for different exercises (e.g. one hand vs. two hand exercises), and to increase weight as they gain strength, require an additional unit for each desired weight.

Another disadvantage is that they lack portability due to their weight and size.

Adjustable kettlebell devices address some of the above disadvantages to a certain degree; most notably the disadvantage of having a fixed single weight. However, these products tend to be very expensive. They also tend to be time-consuming and complicated to adjust, and can be limited in terms of the weight range they cover; for example, many have a maximum weight as low as 25 lbs.

Plate-loaded kettlebell devices also address some of the disadvantages noted above. These devices can be awkward and time consuming to load with the desired weight. Additionally, they require weight plates, which do not tend to be as readily available as dumbbells.

Kettlebell handle adaptors also address some of the above listed disadvantages. U.S. patent application 2012/0252641 for example discloses an adaptor having a clamping mechanism to fasten to a dumbbell bar, and a separate mechanism to rotate the kettlebell handle and lock it into the desired position. U.S. Pat. No. 8,267,841 for example discloses an adaptor having a spring loaded clamping mechanism to secure to the bar of a dumbbell, and also uses a separate mechanism to alternate the handle position. These devices have complicated designs and cannot be attached or removed from the dumbbell bar as quickly or easily as desired.

There is a need for an improved handle adapter for weight training devices that has a relatively simple design and that may be attached or detached to the bar of the weight training device relatively quickly and easily. Preferably, such handle adaptor may be produced at a relatively low cost and be sufficiently light weight for portability.

SUMMARY

In one aspect the invention provides a handle adaptor for a weight training device, the handle adaptor comprising:

a handle extending from a neck, said neck having a first end and a second end;

at least one slot defined in said neck, said slot having an opening adapted for receiving a bar of the weight training device and a seat adapted for supporting the bar of the weight training device; and a biasing member adapted to releasably bias the bar in the seat of said slot.

In another aspect the invention provides a handle adaptor for a weight training device, the handle adaptor comprising:

a handle extending from a neck, said neck having a first end and a second end; and at least one slot defined in said neck, said slot having an opening adapted for receiving a bar of the weight training device and a seat adapted for supporting the bar of the weight training device, wherein said handle is oriented in a first position when said bar is disposed in the opening of said slot and said handle is oriented in a second position when said bar is disposed against the seat of said slot.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Figure 1:
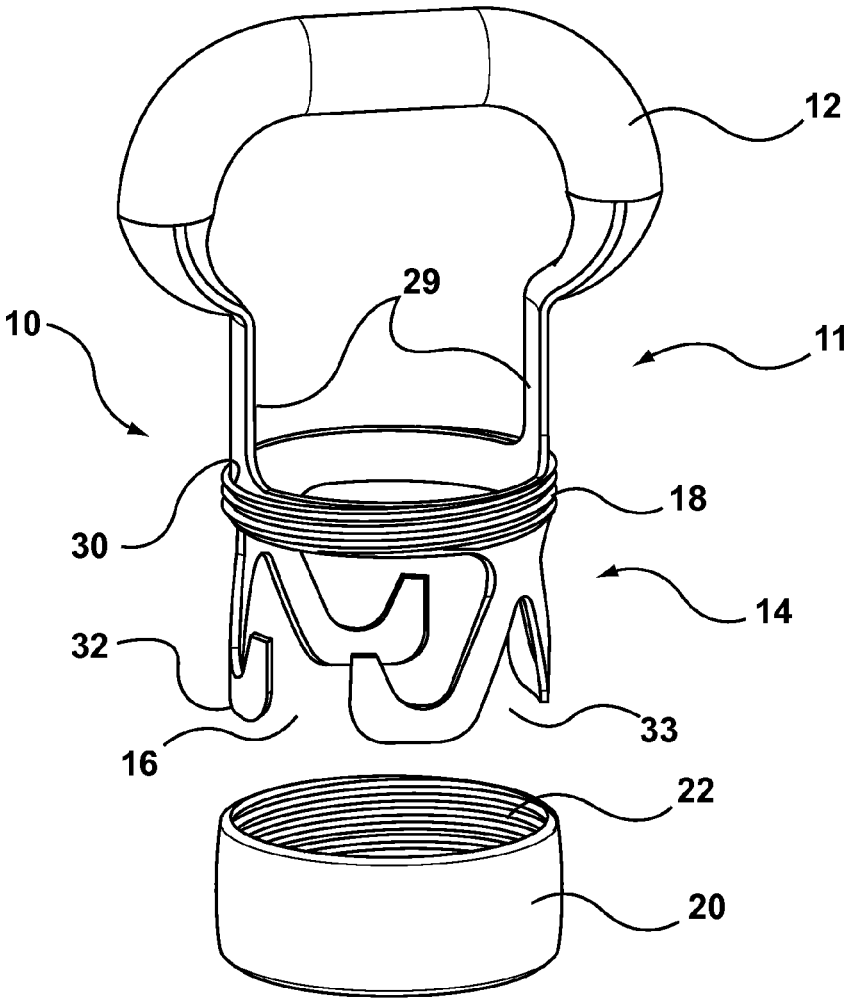
FIG. 1 is an exploded perspective view of the main body and biasing member for a handle adaptor in accordance with the present invention.
Figure 7:
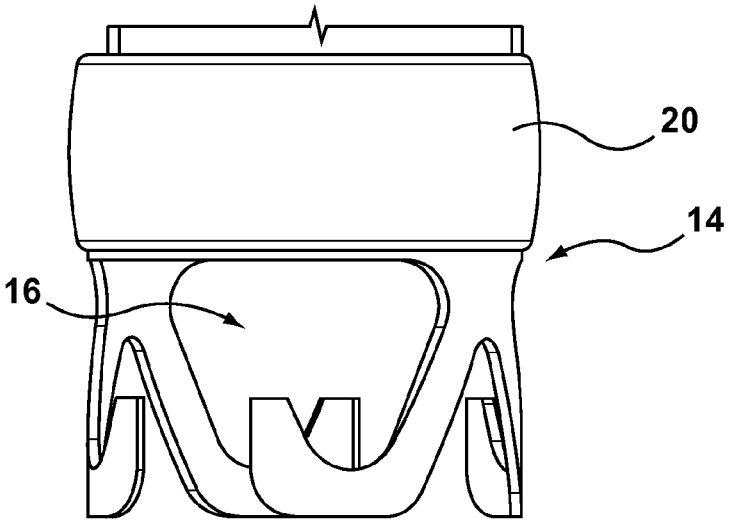
FIG. 7 is a side view of the neck of the handle adaptor with the biasing member in its open position.
Figure 3:
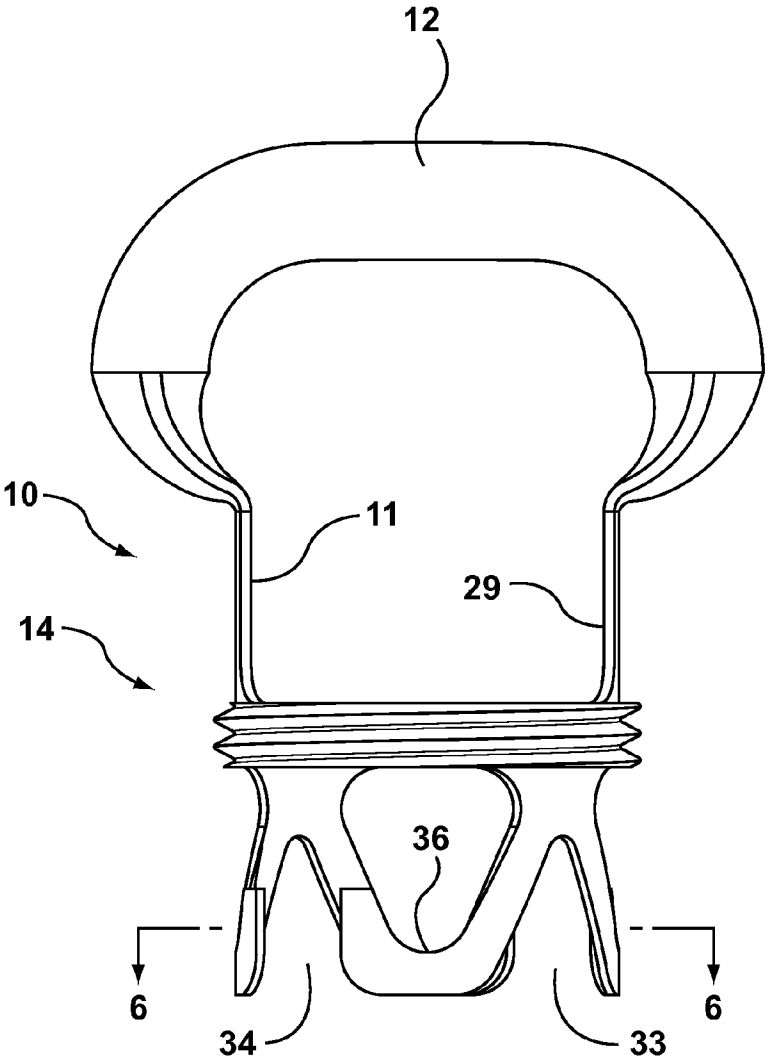
FIG. 3 is a side view of the main body of the handle adaptor shown in FIG. 1, as viewed along the plane transverse to the plane of the handle.
Figure 2:
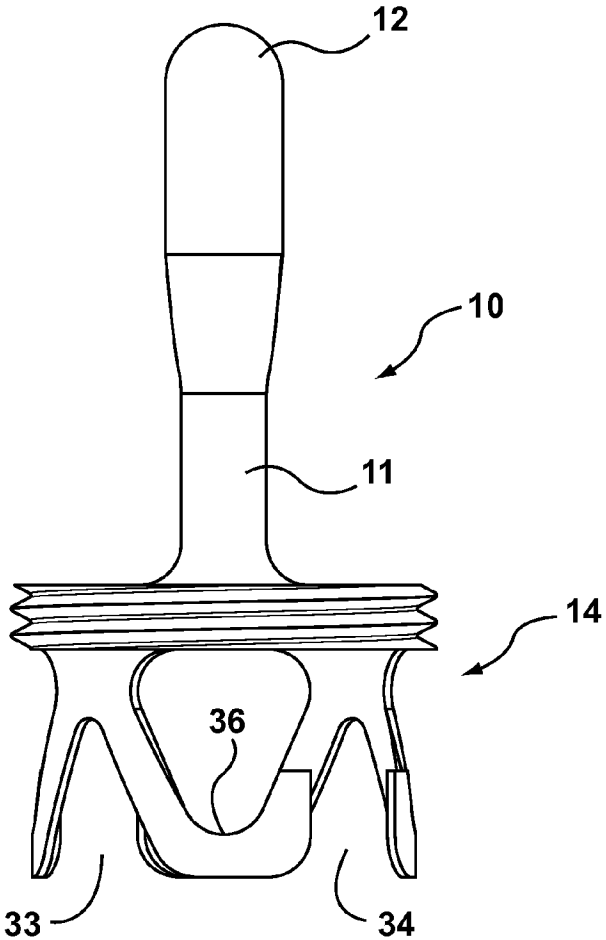
FIG. 2 is a side view of the main body of the handle adaptor shown in FIG. 1, as viewed along the plane of the handle.
Figure 4:
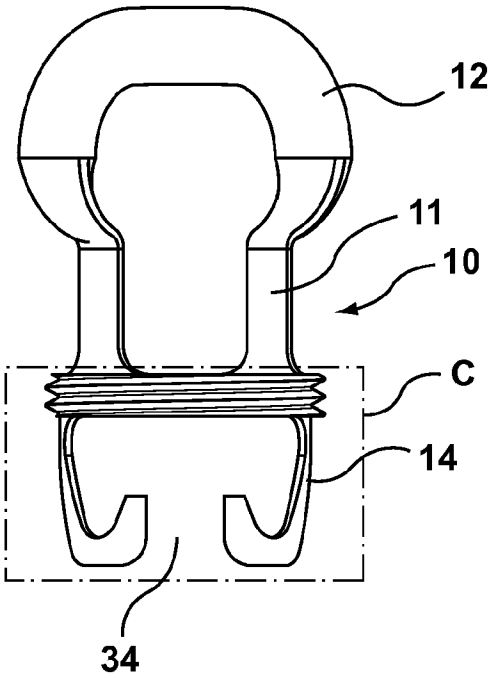
FIG. 4 is a side view of the main body of the handle adaptor shown in FIG. 1, as viewed along the plane of the opening for the slot.

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A handle adaptor in accordance with the present invention is shown generally at 10 in the Figures.

Handle adaptor 10 comprises a main body 11 having a handle 12, a neck 14 and at least one slot 16 defined in neck 14. A thread 18 is defined in neck 14 to receive a biasing member 20 having a corresponding thread 22.

Handle adaptor 10 is adapted to fit over a bar 24 of a weight training device 26 such as a dumbbell or a barbell (as shown in FIGS. 8-13). Weight training device 26 may include one or more weights 28 that are permanently or removably supported by bar 12.

Handle adaptor may be formed from a variety of materials including steel, aluminum and plastic. Steel is currently most preferred due to its low cost, strength and durability. It is preferable that handle 12 and neck 14 are integrally formed from one material for instance by casting or molding.

Handle 12 is shaped and sized to be gripped by a user during the performance of desired exercises. Handle 12 may have a wide curvilinear shape similar to the shape of handles for kettlebell weight training devices that may be gripped by one or both hands of a user. For example, handle 12 may have a width of approximately 8 inches, a thickness of approximately 1.375 inches and a spacing below the handle of approximately 2.8 inches. Handle 12 may alternatively be narrower or have an alternate shape depending upon the desired preferences of the user. Handle 12 may be integrally connected to neck 14 or releasably connected. Handle 12 may include arms 29 to connect to neck 14.

Neck 14 has a first end 30 located proximate to handle 12 and a second end 32 located away from handle 12. Neck 14 preferably is cylindrical in shape to facilitate attachment of biasing member 20. Neck 14 may be hollow (as shown) to reduce weight or it may be solid for added rigidity and support. In the case of a hollow neck 14, cutouts 33 may also be provided to further reduce weight provided that rigidity and support are not unduly compromised. Neck 14 may for example have an outside diameter of approximately 4.25 inches and a length between first end 30 and second end 32 of approximately 4 inches.

Slot 16 comprises an opening 34 at second end 32 of neck 14 for receiving bar 24 and a seat 36 for supporting bar 24. For example, slot 16 may have a width of 1.6 inches at opening 34 to receive a bar 24 that has a diameter of up to 1.5 inches.

Figure 6:
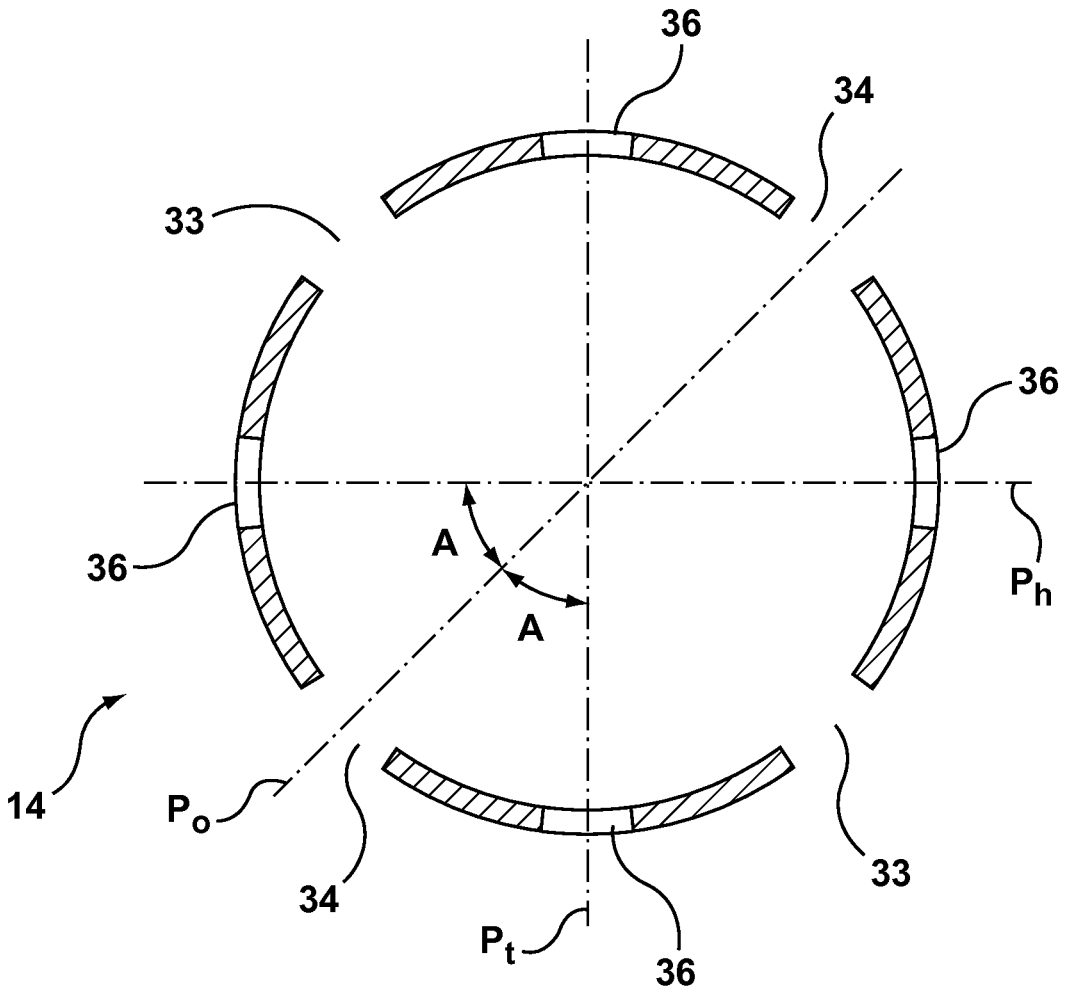
FIG. 6 is a sectional view of the neck of the handle adaptor as viewed along lines 6-6 in FIG. 3.

As shown in FIG. 6, seat 36 is preferably disposed along a plane Ph of handle 12 or along a plane Pt that is transverse to plane Ph of handle 12. It will be understood that seat 36 may be disposed along alternate planes instead or as well to allow alternate orientations of handle 12 relative to bar 24.

Opening 34 is preferably disposed along a plane Po that is offset by an angle A of between 0 to 90 degrees from the plane in which corresponding seat 34 is disposed, more preferably the offset angle A is between 30 to 60 degrees and most preferably the offset angle A is approximately 45 degrees.

Figure 5:
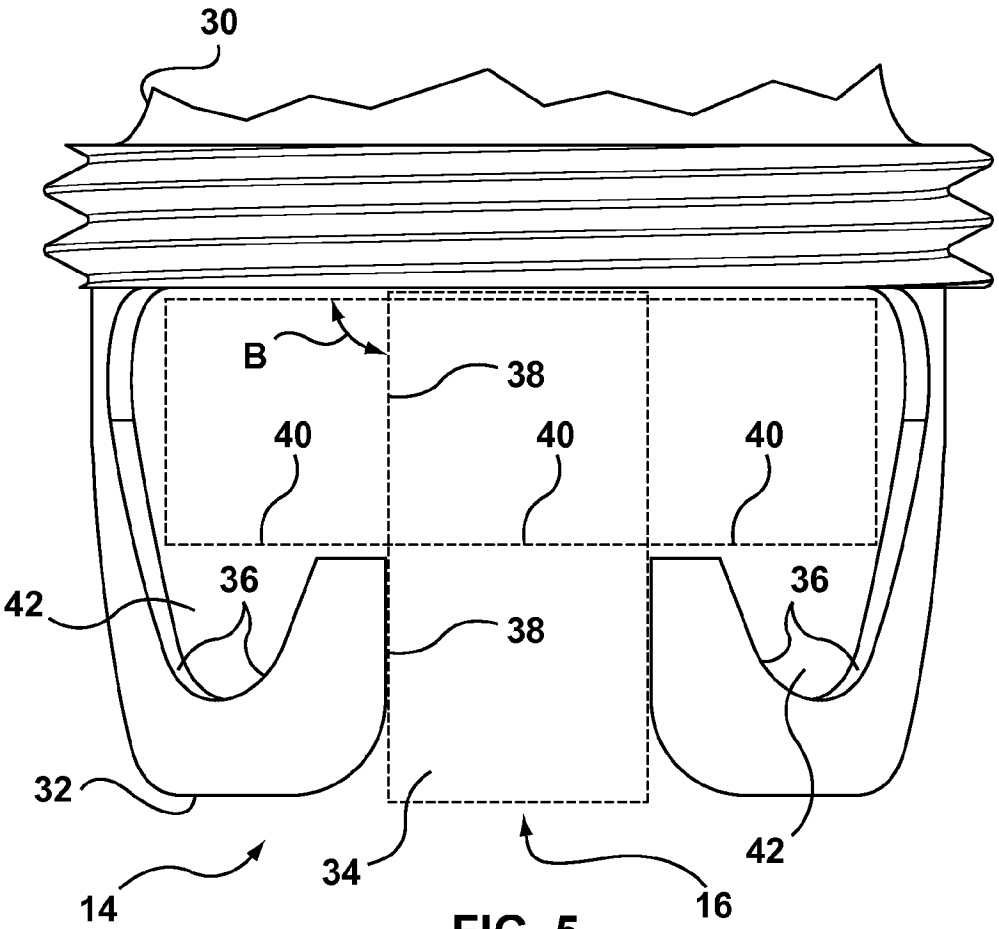
FIG. 5 is an enlarged side view of the neck of the handle adaptor shown in FIG. 4 as viewed in region C.

As shown in FIG. 5, slot 16 preferably has a first portion 38 that defines opening 34 and extends from second end 32 of neck 14 towards first end 30 of neck 14. Slot 16 may then have a second portion 40 that extends at an angle B relative to first portion 38. Angle B is preferably between 30 to 150 degrees, more preferably between 60 to 120 degrees and most preferably approximately 90 degrees.

Slot 16 may further include a groove or recess 42 that extends between second portion 40 of slot 16 and second wall 32 of neck 14 to better support bar 24 within slot 16. Recess 42 may have tapered walls to support bars 24 of different diameter. Recess may for instance have a spacing of 1 inch at the bottom of recess 42 tapering outwardly to 1.5 inches or more at the top portion of recess 42. It will be understood that a plurality of recesses 42 may be defined along second portion 40 of slot 16 to enable handle adaptor 10 to be secured with handle 12 at one of a plurality of angles relative to bar 24. For example, second portion 40 of slot 16 may include a first recess 42*a* that extends along a first plane and a second recess 42*b* that extends along a second plane that is offset from first plane P1 by an angle of approximately 45 degrees.

Figure 12:
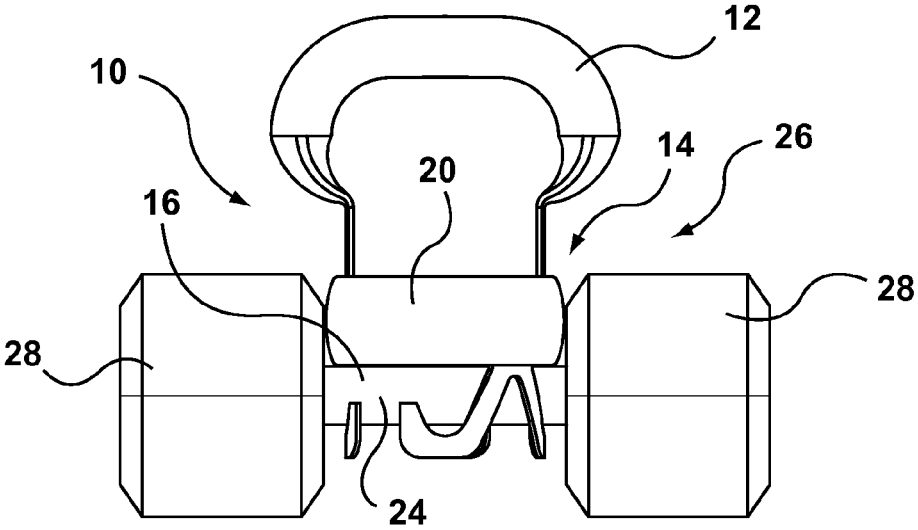
FIG. 12 is a side view of the handle adaptor secured to the bar of the weight training device, with the handle extending in the same plane as the bar.
Figure 13:
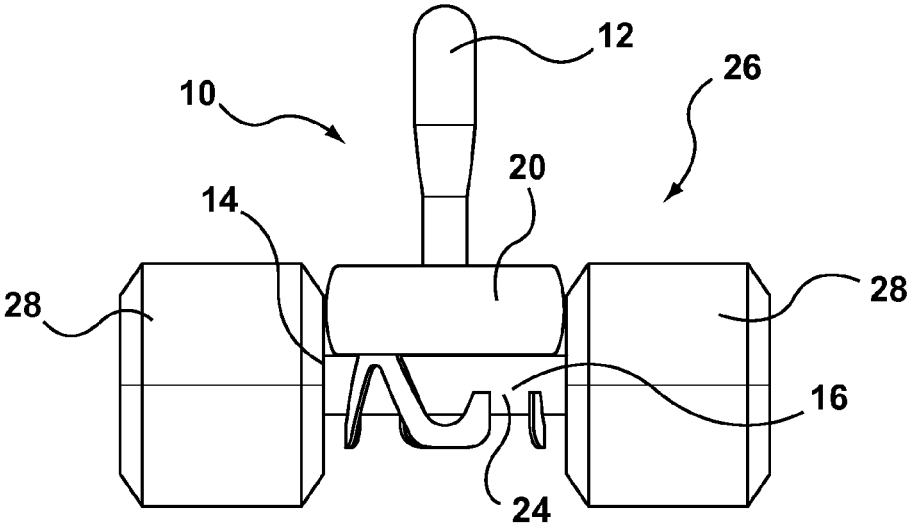
FIG. 13 is a side view of the handle adaptor secured to the bar of the weight training device, with the handle extending in a transverse plane to the bar.

Preferably, a pair of slots 16 are defined in neck 14 to allow handle adaptor 10 to be secured to bar 24 in one of two positions (preferably a first position where handle 12 is in the same plane as bar 24 as shown in FIG. 12 and a second position where handle 12 is in a plane that is transverse to the bar 24 as shown in FIG. 13).

In cases where neck 14 is hollow, slot 16 comprises a first portion 16*a* defined in one side of neck 14 and a corresponding second portion 16*b* defined in the opposing side of neck 14. In the case where neck 14 is solid, slot 16 comprises a single portion defined fully through neck 14.

Biasing member 20 is provided to releasably secure handle adaptor 10 to bar 24. Biasing member 20 may comprise a threaded collar, a clamp (such as disclosed in 2012/0252641—the subject matter of which is entirely incorporated herein by reference), a slidable collar (such as disclosed in U.S. Pat. No. 5,163,887—the subject matter of which is entirely incorporated herein by reference), a wedge or any other suitable mechanism. A threaded collar is the currently preferred mechanism due to its simplicity and low cost and is described in more detail below.

Figure 14:
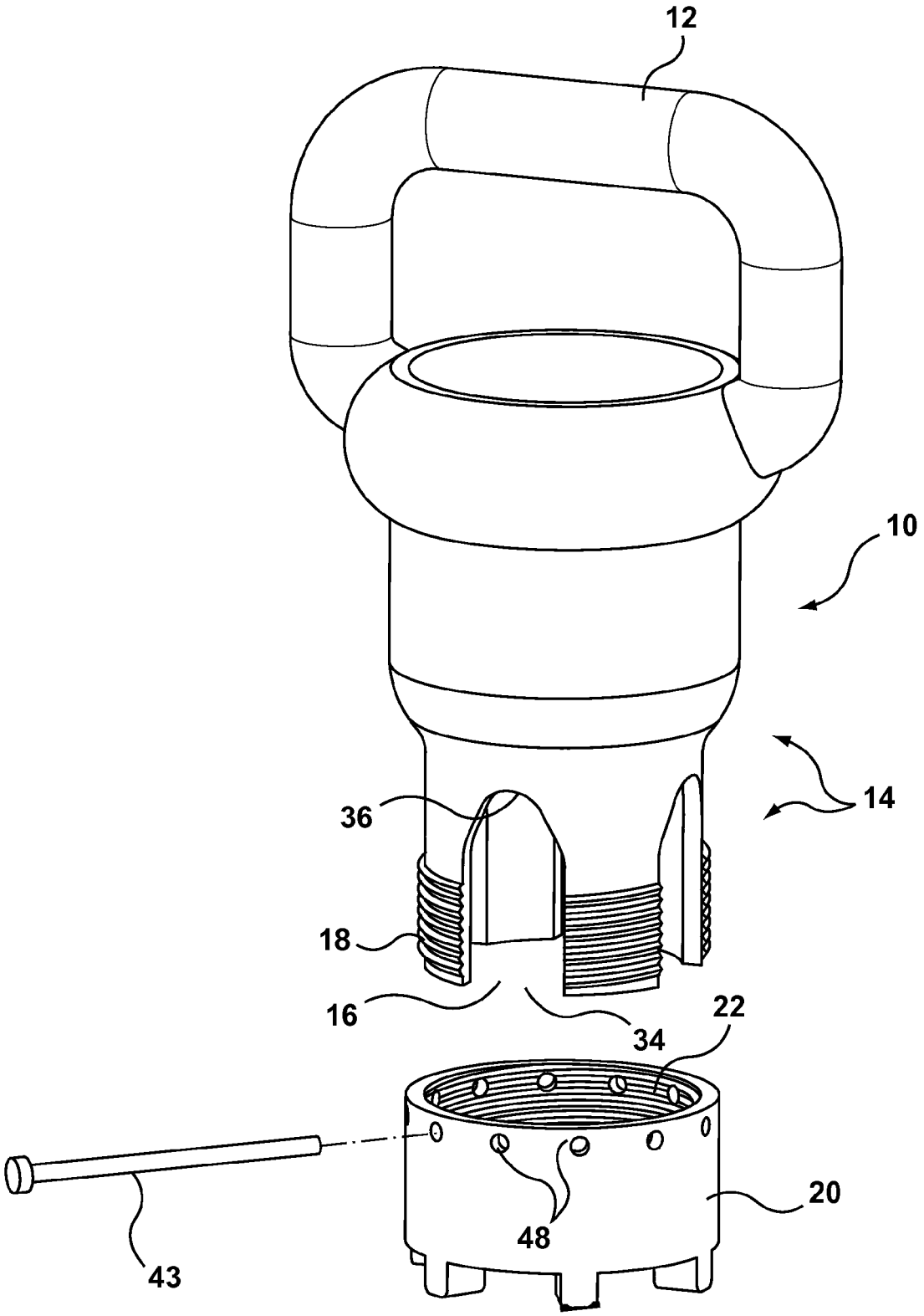
FIG. 14 is an exploded perspective view of the main body and biasing member for a handle adaptor in accordance with a second embodiment of the present invention.

Biasing member 20 having thread 22 is adapted to be rotatably connected to corresponding thread 18 defined in neck 14. Biasing member 20 is adapted to be moved between an open position, where bar 24 is free to move within slot 16, to a closed position, where bar 24 is restricted from moving within slot 16. A lock 46 such as a set screw or pin adapted to extend through corresponding apertures 48 (as shown in FIG. 14) may also be provided to lock biasing member into place. Gaskets (not shown) may be disposed on biasing member 20 and/or in slot 16 to reduce slippage and protect both handle adaptor and bar 24 from wear and tear.

It will be understood that thread 18 may be defined on the inner surface of neck 14 (in the case of a hollow neck) with corresponding thread 22 being defined on the outer surface of biasing member. The preferred embodiment however provides thread 18 on the outer surface of neck 14 and thread 22 on the inner surface of biasing member 20.

Biasing member 20 preferably has a rounded profile to provide a resting surface for a user's arm or hand during use of handle adaptor. For example, biasing member 20 may have a height of 2.25 inches and an outside diameter of 4.75 inches.

Figure 8:
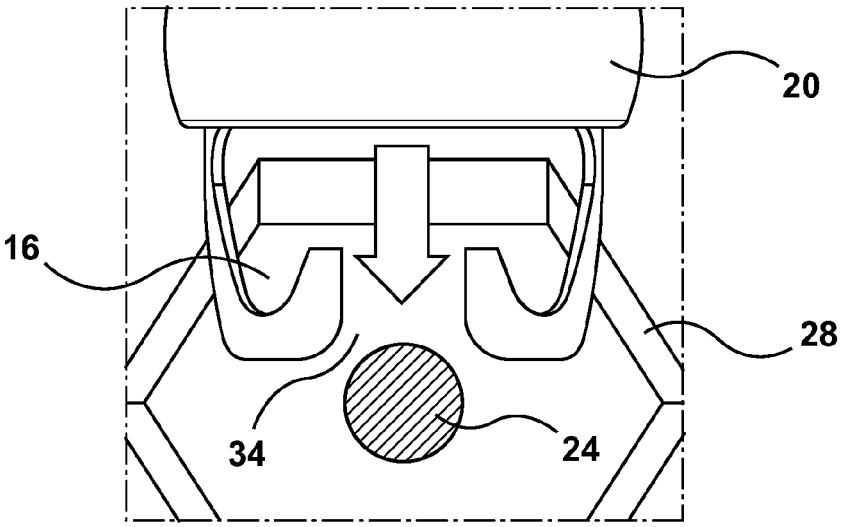
FIG. 8 is a side view of the neck of the handle adaptor with the biasing member in its open position showing the handle adaptor being lowered onto a bar of a weight training device.
Figure 9:
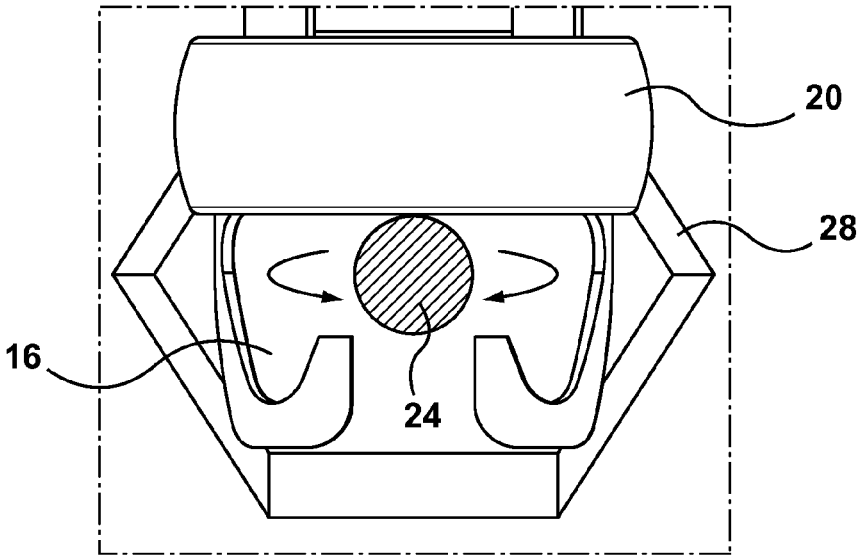
FIG. 9 is a side view of the neck of the handle adaptor with the biasing member in its open position showing the bar of the weight training device disposed in the first portion of the slot.
Figure 10:
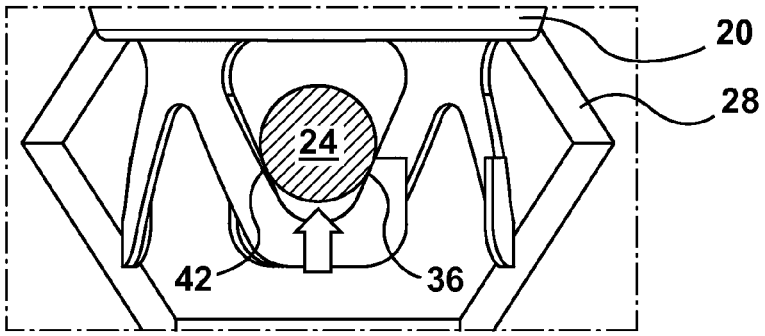
FIG. 10 is a side view of the neck of the handle adaptor with the biasing member in its open position showing the bar of the weight training device disposed in the recess against the seat in the second portion of the slot.
Figure 11:
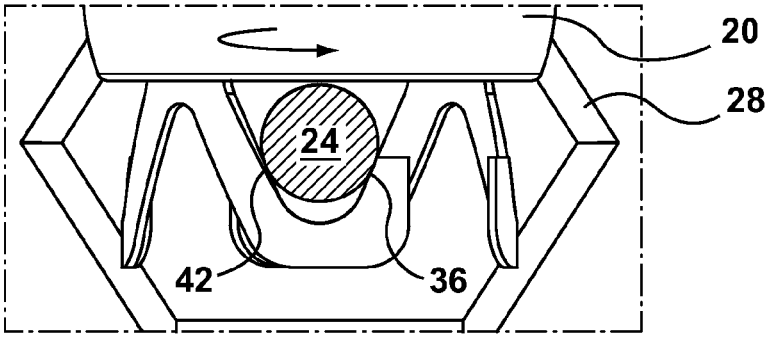
FIG. 11 is a side view of the neck of the handle adaptor with the biasing member in its closed position biasing the bar of the weight training device against the seat of the slot.

During use, handle adaptor 10, with biasing member 20 in its open position, is positioned over a bar 24 of a weight training device (as shown in FIG. 8). Handle adaptor 10 is then lowered over bar 24 so that bar 24 enters opening 34 of slot 16 and is guided to second portion of slot 16 in order that handle adaptor 10 may be rotated in either direction (as shown in FIG. 9). Once handle adaptor 10 has been rotated, handle adaptor is lifted until bar 24 is disposed in recess 42 and is supported by seat 36 (as shown in FIG. 10). Biasing member 20 is then moved by rotation from its open position to its closed position where it engages bar 24 and biases bar 24 against seat 36 (as shown in FIG. 11). Handle adaptor is now in condition to be used for training exercises. It may be seen in FIGS. 12 and 13, that the two slots 16 allow handle adaptor to be positioned on bar 24 such that handle 12 is in the same plane as bar 24 (as shown in FIG. 12) or is in a transverse plane from bar 24 (as shown in FIG. 13). Handle adaptor 10 may be detached from bar 24 by reversing the operations as described above.

In a first embodiment of the invention as shown in FIGS. 1 to 13, thread 18 is defined proximate to first end 30 of neck 14. Thus, as shown in FIGS. 7-10, biasing member 20 may be rotated to its open position toward handle 12 in order that handle adaptor 10 may be attached or detached from bar 24. As shown in FIGS. 11-13, once bar 24 is disposed in slot 16, biasing member 20 may be rotated to its closed position away from handle 12 to bias bar 24 against seat 36 and thus secure handle adaptor 10 to bar 24 of weight training device.

In a second embodiment of the invention as shown in FIG. 14, thread 18 is defined proximate to second end 32 of neck 14. Biasing member 20 may be rotated to its open position away from handle 12 and removed from neck 14 in order that handle adaptor 10 may be attached or detached from bar 24. Once bar 24 is disposed in slot 16, biasing member 20 may then be threaded back onto neck 14 and rotated to its closed position toward handle 12 to bias bar 24 against seat 36. It may be seen in FIG. 14 that slot 16 extends partway from second end to first end of neck 14 with seat 36 aligned with opening 34.

Figure 15:
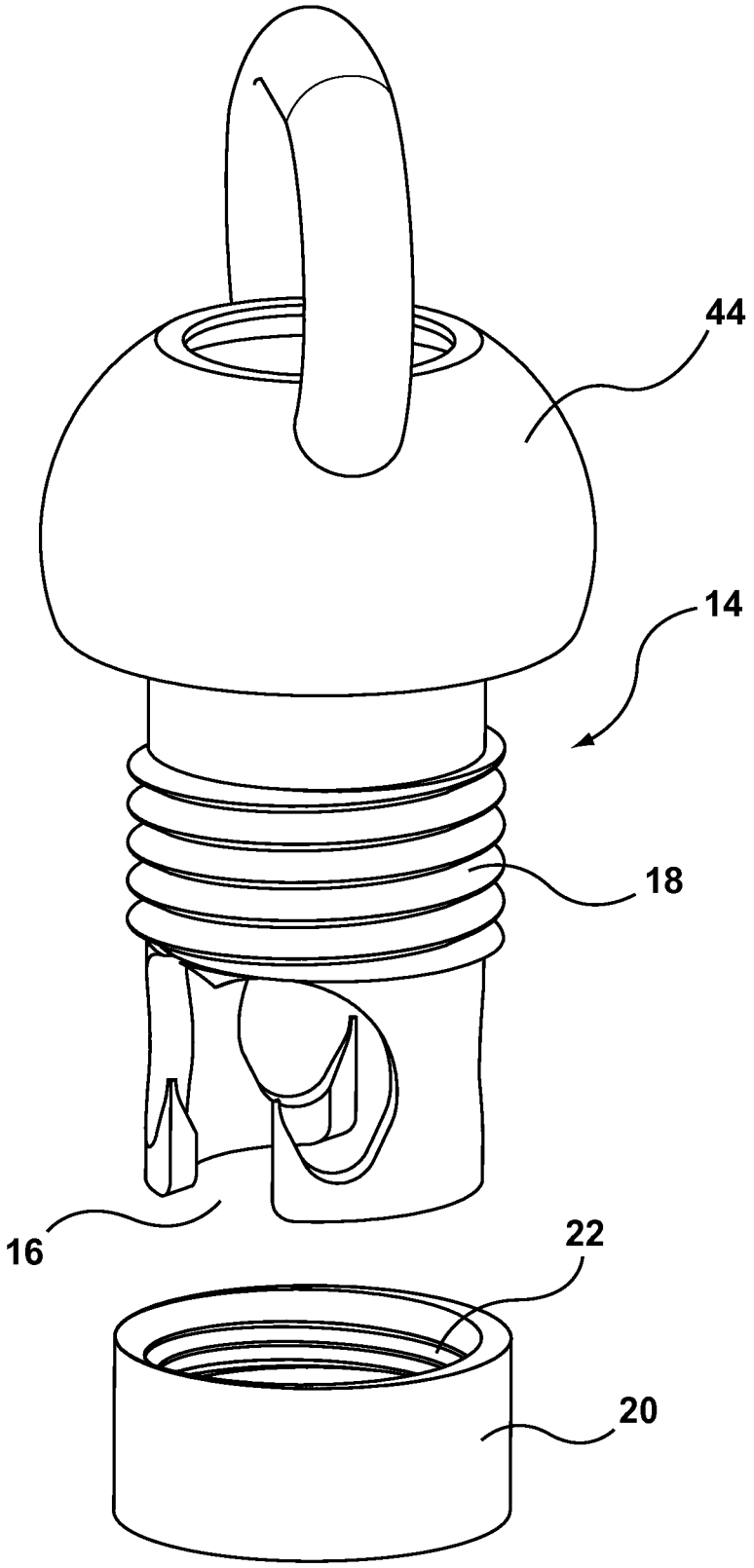
FIG. 15 is an exploded perspective view of the main body and biasing member for a handle adaptor in accordance with a third embodiment of the present invention.

In a third embodiment of the invention, as shown in FIG. 15, a rest 44 is defined between handle 12 and neck 14. Rest 44 preferably has a rounded profile to provide a resting surface for a user's arm or hand during use of handle adaptor 10. More preferably, rest 44 has a partial spherical shape resembling the portion of a kettlebell immediately below the handle.

Figure 16:
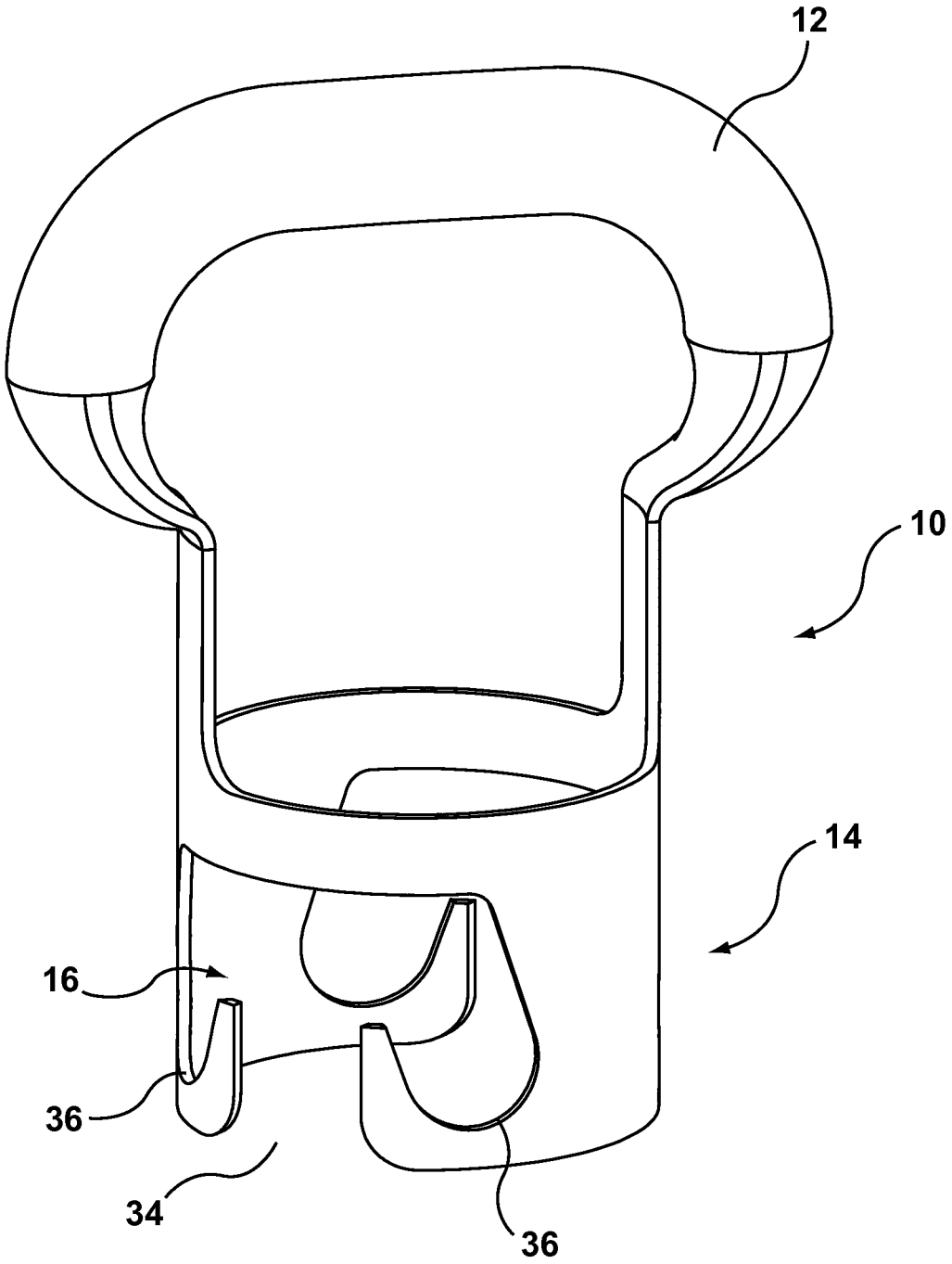
FIG. 16 is an exploded perspective view of a handle adaptor in accordance with a fourth embodiment of the present invention.

In a fourth embodiment of the invention, as shown in FIG. 16, handle adaptor 10 is provided with main body 11 and no biasing member 20. In this embodiment, slot 16 is adapted to secure neck 14 to bar 24 on its own without the need of an external biasing member. In this embodiment, it is preferable that slot 16 and recess 42 are sized with close tolerances to fit with a bar 24 of a specific diameter.

While the above description provides examples of one or more processes or apparatuses, it will be appreciated that other processes or apparatuses may be within the scope of the accompanying claims.

I claim:

1. A handle adaptor for a weight training device, the handle adaptor comprising:

a cylindrical neck having threads on a periphery thereof, the cylindrical neck having a first end and a second end;

a handle disposed at said first end of said cylindrical neck;

at least one slot defined in said second end of said cylindrical neck, said at least one slot having an opening adapted for receiving a bar of the weight training device and a seat adapted for supporting the bar of the weight training device; and a biasing member adapted to releasably engage and bias the bar in the seat of said at least one slot, said biasing member including threads adapted to engage the threads on said cylindrical neck such that rotation of the biasing member in threaded engagement with the threads of the cylindrical neck causes axial movement of the biasing member relative to the cylindrical neck so as to engage and secure the bar in the seat.

2. The handle adaptor of claim 1, wherein said cylindrical neck is hollow and said at least one slot comprises a first portion defined in one side of the hollow cylindrical neck and a corresponding second portion defined in the opposing side of said hollow cylindrical neck.

3. The handle adaptor of claim 1, wherein said threads defined in said cylindrical neck are disposed between said handle and said at least one slot.

4. The handle adaptor of claim 1, wherein said threads defined in said cylindrical neck are disposed at the second end of said cylindrical neck.

5. The handle adaptor of claim 1, wherein said threads of said biasing member are internal threads adapted to engage the threads defined on said cylindrical neck.

6. The handle adaptor of claim 1, wherein said at least one slot has a first portion and a second portion that are oriented at an angle of between 30-150 degrees from one another.

7. The handle adaptor of claim 1, wherein said at least one slot comprises a first slot adapted for securing said handle in a first orientation relative to the bar, and a second slot adapted for securing said handle in a second orientation, different from said first orientation, relative to said bar.

8. The handle adaptor of claim 1, wherein said handle is oriented in a first position when said bar is disposed in the opening of said at least one slot and said handle is oriented in a second position when said bar is disposed against the seat of said at least one slot.

9. The handle adaptor of claim 8, wherein rotation of said handle from said first position to said second position releasably secures said bar to said cylindrical neck.

10. The handle adaptor as claimed in claim 9, wherein said bar is lockably secured to said cylindrical neck.

11. A handle adaptor for a weight training device, the handle adaptor comprising:

a neck having a first end and a second end;

a handle disposed at said first end of said neck;

at least one slot defined in said neck, said at least one slot having an opening adapted for receiving a bar of the weight training device and a seat adapted for supporting the bar of the weight training device, wherein said handle is oriented in a first position when said bar is disposed in the opening of said at least one slot and said handle is oriented in a second position when said bar is disposed against the seat of said at least one slot;

wherein rotation of said handle from said first position to said second position about an axis perpendicular to a longitudinal axis of the bar releasably secures said bar to said neck so that the bar cannot be removed from the neck without rotating the handle about the axis perpendicular to the longitudinal axis of the bar back to said first position.

12. The handle adaptor of claim 11, wherein said opening is disposed in a plane that is offset by an angle of between 0-90 degrees from the plane in which said seat is disposed.

13. The handle adaptor of claim 11, wherein said at least one slot has a first portion and a second portion that are oriented at an angle of between 30-150 degrees from one another.

14. The handle adaptor of claim 11, further comprising a biasing member adapted to releasably bias the bar in the seat of said at least one slot.

15. The handle adaptor of claim 11, wherein said at least one slot comprises a first slot adapted for securing said handle in a first orientation relative to the bar, and a second slot adapted for securing said handle in a second orientation, different from said first orientation, relative to said bar.

16. A handle adaptor for a weight training device, the handle adaptor comprising:

a neck having a first end and a second end;

a handle disposed at said first end of said neck;

a first slot and a second slot defined in said second end of said neck, each said slot having an opening adapted for receiving a bar of the weight training device and a seat adapted for supporting the bar of the weight training device; said first slot being adapted for securing said handle in a first position relative to the bar, and said second slot being adapted for securing said handle in a second position, different from said first position, relative to said bar; and a biasing member adapted to releasably engage and bias the bar in the seat of said first slot or said second slot.

17. The handle adaptor of claim 16, wherein said opening for each of said first slot and said second slot is disposed in a plane that is offset by an angle of between 0-90 degrees from the plane in which said corresponding seat is disposed.

18. The handle adaptor of claim 16, wherein each of said first slot and said second slot has a first portion and a second portion that are oriented at an angle of between 30-150 degrees from one another.

19. The handle member of claim 16, wherein said neck is cylindrical and said biasing member includes a thread adapted to engage a corresponding thread defined on said neck.

20. The handle member of claim 16, wherein said first position is in the same plane as the bar and said second position is in a plane that is transverse to the bar.

* * * * *